US009321579B2

(12) United States Patent
Chen

(10) Patent No.: US 9,321,579 B2
(45) Date of Patent: Apr. 26, 2016

(54) DAILY APPARATUS, CONTAINER, REMOVING METHOD THEREOF AND APPLICATION THEREOF

(71) Applicant: BEIJING RED-SEA TECH CO., LTD., Beijing (CN)

(72) Inventor: Zengxin Chen, Beijing (CN)

(73) Assignee: BEIJING RED-SEA TECH CO., LTD., Beijing (CN)

( * ) Notice: Subject to any disclaimer, the term of this patent is extended or adjusted under 35 U.S.C. 154(b) by 0 days.

(21) Appl. No.: 14/364,690

(22) PCT Filed: Dec. 13, 2012

(86) PCT No.: PCT/CN2012/086504

§ 371 (c)(1),
(2) Date: Jun. 12, 2014

(87) PCT Pub. No.: WO2013/086991

PCT Pub. Date: Jun. 20, 2013

(65) Prior Publication Data

US 2014/0326757 A1 Nov. 6, 2014

(30) Foreign Application Priority Data

Dec. 13, 2011 (CN) ..... 2011 1 0416889
Feb. 10, 2012 (CN) ..... 2012 1 0029694

(51) Int. Cl.
*B65D 37/00* (2006.01)
*B65D 83/16* (2006.01)
(Continued)

(52) U.S. Cl.
CPC ..... *B65D 83/16* (2013.01); *B05B 9/0816* (2013.01); *B65D 25/38* (2013.01); *B65D 83/42* (2013.01); *A47G 19/12* (2013.01)

(58) Field of Classification Search
CPC .. B05B 9/0816; B05B 9/0877; B05B 9/0883; B65D 25/38; B65D 83/16; B65D 83/24; B65D 83/42; B65D 83/425; B65D 83/48; G01F 15/065
USPC ..... 222/1, 185.1, 207, 209, 306, 402.18, 222/491
See application file for complete search history.

(56) References Cited

U.S. PATENT DOCUMENTS 2,063,430 A * 12/1936 Graser ..... 222/386.5
4,442,957 A * 4/1984 Neal et al. ..... 222/207
(Continued)

FOREIGN PATENT DOCUMENTS

CN 201761791 3/2011
CN 202439983 9/2012
(Continued)

*Primary Examiner* — Frederick C Nicolas
*Assistant Examiner* — Bob Zadeh
(74) *Attorney, Agent, or Firm* — Mark M. Friedman

(57) ABSTRACT

A daily apparatus for removing a content from a container, a container having a structure of the daily apparatus and a removing method thereof are provided. The apparatus comprises a pressurizing part, a pressure transmitting channel, an outflow channel, and a content-removing part; an inside of the content-removing part and/or the pressure transmitting channel is provided with a piston, the pressure transmitting medium is on a side of the piston, and the content is on the other side; the content-removing part is provided with an opening connected to the content in the container, the opening can be opened or closed by a mobile device; when the pressurizing part is applying a pressure, the opening is closed, the content in the content-removing part flows out; and after the pressure ceases being applied, the pressure transmitting medium flows back, the content in the container enters the content-removing part.

25 Claims, 9 Drawing Sheets

(51) Int. Cl.

| | |
|---|---|
| ***B65D 25/38*** | (2006.01) |
| ***B05B 9/08*** | (2006.01) |
| ***B65D 83/42*** | (2006.01) |
| *A47G 19/12* | (2006.01) |

(56) References Cited

U.S. PATENT DOCUMENTS

| | | | | |
|---|---|---|---|---|
| 4,595,121 | A * | 6/1986 | Schultz | 222/1 |
| 4,763,818 | A | 8/1988 | Stefano | |
| 5,186,391 | A * | 2/1993 | Roueche et al. | 239/373 |
| 5,439,144 | A * | 8/1995 | Holzner | 222/189.06 |
| 2005/0218156 | A1 * | 10/2005 | Goldberg | 222/145.5 |

FOREIGN PATENT DOCUMENTS

| | | |
|---|---|---|
| CN | 202449415 | 9/2012 |
| CN | 202624980 | 12/2012 |
| FR | 2510071 | 1/1983 |

* cited by examiner

DAILY APPARATUS, CONTAINER, REMOVING METHOD THEREOF AND APPLICATION THEREOF

FIELD OF THE INVENTION

The present invention relates to a daily apparatus, a container, a method for removing a content from the container, and applications of the apparatus and the container to the field of food, daily chemical products, disinfection products and pharmaceutical products.

BACKGROUND OF THE INVENTION

Since daily products are getting diverse, people use more various containers for containing hand sanitizers, laundry detergents, disinfectants, shampoos, shower gels, toothpastes, soy sauces, vinegar, oil, liquid medicines, and so on. Although these containers have different shapes, the methods for removing the contents from the container are no more than these two: inclining the containers so as to pour the content out, and removing the content from the container by using dispenser.

The container for pouring the content out of container typically has only an opening, and the opening is on the top. In use, the container must be inclined to allow the contents to flow out. For some of the containers, the container wall must also be squeezed to make the content flow. These containers have four disadvantages: (1) The method for removing the contents inevitably allows outside air and impurities to easily enter the container, so that the contents are exposed to more air, and may deteriorate due to reduction and oxidation, or contamination with germs or impurities. (2) It is very inconvenient to remove the contents from the container, such as shampoo, or shower gel. After more than a half thereof is used, the container has to be inverted for a long time to allow the contents flow to the opening for use, which is inconvenient, and the last remainder of the contents may also be wasted. (3) The product (in particular, such as toothpaste) can only be packed in a small package, and often cannot be completely used, which not only is wasteful, but also generates much waste packaging material, causing pollution. (4) When the contents are being removed, due to too many factors, such as the inclined angle, air flow, and the size of the opening, the amount removed can not be certain, measured, and controlled precisely. An excessive amount of the contents is often removed, resulting in waste and environmental pollution.

Using a spencer to remove the content from the container is another common method for removing liquid content. Spencers are often used, especially in the containers which have large volume, and are not suitable for being inverted or squeezed. These containers also have four disadvantages: (1) The amount of liquid removed cannot be precisely controlled. The force of the downward press on the spencer cannot be precisely controlled, so that the amount dispensed is often measured only by the number of times the dispenser is pressed. The amount of liquid removed cannot be precisely controlled. (2) The liquid removed cannot have too high of a viscosity or consistency. Since the spencer has to draw the liquid to a higher place first for removing it, if the viscosity or consistency of the liquid is too high, the liquid can not be drawn to the higher place, and the liquid cannot be removed. (3) The means has higher manufacturing costs. The spencer structure is complicated, and the container walls and other existing components cannot be utilized, causing higher manufacturing costs. (4) The method cannot be continuously used. Since the spencer can only move the contents in the limited space near the outlet of the straw, after the contents in the space are removed, the spencer has to re-draw the contents in the container before removing the contents again. Therefore the contents can only be removed intermittently, not continuously.

Users need a simple and practical container in daily life, which allows the process of removing the contents every time to be more controllable by users at will, and reduces the effects of outside air or impurities as much as possible.

SUMMARY OF THE INVENTION

To resolve the problems arising from the lack of a container and apparatus for conveniently obtaining a content from a container in the prior art, the present invention provides an apparatus for removing a content from a container, comprising a pressure transmitting channel, a pressurizing part for applying pressure to the inside of the pressure transmitting channel through a pressure transmitting medium in the pressure transmitting channel to transmit the pressure which is applied by the pressurizing part, and an outflow channel for allowing the content to flow out and preventing the content from flowing back, wherein a content-removing part is located on the bottom of the container between the pressure transmitting channel and the outflow channel, the content-moving part is provided with an opening connected to the content in the container, the moving direction of a mobile device, which can open or close the opening, is vertical with respect to the channel of the opening, when the pressurizing part is applying the pressure, the opening is closed under the pressure, the content in the content-removing part flows out through the outflow channel under the pressure transmitted from the pressure transmitting medium in the pressure transmitting channel, and the pressurizing part, the pressure transmitting channel, or the content-removing part is provided with a reposition device and/or an elastic recovery function so that after the pressure is no longer applied, the pressure transmitting medium flows back to the same position as before the pressure was applied. Backflow is prevented through a one-way valve or other common means disposed in the outflow channel. A reposition device can return to the staring position, and drive the pressure transmitting medium which transmits the pressure to the starting position, such as a piston with an end which is fixed to a wall and which is driven by an elastic part. The elastic recovery function means that the pressurizing part and pressure transmitting channel can elastically recover after the pressure is no longer applied, so that the pressure transmitting medium which transmits the pressure returns to the starting position. After the pressure transmitting medium returns to the starting position, all or part of the content enters the content-removing part.

The apparatus can remove the content from the container easily, and substantially overcome the aforementioned problems in the prior art.

Since the pressure is only applied to the content in the content-removing part and the outflow channel, not to the entirety of the content in the container, the pressure required is little, and the content can easily be removed. Moreover, since the removing process is only affected by a single factor, pressure, the process can be precisely controlled, the amount removed is not uncertain, and when the content is removed from the container multiple times, the amount of the content removed is reproducible When the apparatus for removing the content in accordance with the embodiment of the present invention is used to remove the content, since it is not necessary to invert the container, or to squeeze the main body of the container, air, particles, and other impurities do not frequently enter the main body of the container, which prevents the content from being contaminated or deteriorating.

In the apparatus for removing content in accordance with the embodiment of the present invention, by immersing the content-removing part in the content, the opening of the content-removing part can be larger, and even disconnected from the outflow channel temporarily, which allows liquid and paste to enter the content-removing part more easily, and accomplishes removing liquid and paste with high viscosity and consistency.

In the apparatus for removing content in accordance with the embodiment of the present invention, using a mobile device whose moving direction is vertical with respect to the channel of the opening to open or close the opening has at least the following advantages: (1) Closing or opening the opening is more convenient. Compared with closing or opening the opening from the front, closing or opening the opening from the side does not have to overcome the resistance caused by the pressure changes in the content-removing part, which makes closing or opening more convenient. (2) Closing or opening the opening is complete. When the opening is being closed or opened from the side, when the pressure is applied and the content is removed, the opening will not be incompletely opened or closed due to great pressure. When it is required to open the opening, the opening will not be opened incompletely due to the mobile device in the channel of the opening.

The apparatus can be sold separately, and used with other containers or other devices without the function of removing the content. After the apparatus is used, it can be conveniently reused. This allows consumers to select the containers by themselves, and can save costs and reduce waste.

The apparatus structure relative to a spenser is simple, has no overly complicated parts, is more practical, and is favorable for large-scale production or mass production.

In a condition, the mobile device of the apparatus is a piston disposed in the pressure transmitting channel or the content-removing part, and the piston can slide forward or backward due to a positive change or a negative change in the pressure at an end of the pressure transmitting channel, so as to open or close the opening. The presence of the piston can display the movement of the pressure transmitting medium more clearly for indicating the volume of the content flowing out, and transmitting the pressure changes more directly, so that the opening is closed or opened more sensitively and completely.

Furthermore, the piston has a longer lateral circumferential wall, and when the pressure is applied, the piston moves to the opening and closes the opening. The longer lateral circumferential wall means that the piston itself is longer, or the piston is shorter but has a longer lateral circumferential wall, so as to close the opening during the movement thereof. The fact that the opening is closed or opened directly by the piston has three advantages: (1) The apparatus structure is simpler and not easily damaged. (2)Closing or opening the opening is more instantaneous. (3) The opening is opened more completely, which is favorable for allowing content with a higher viscosity or consistency to enter the content-removing part.

Furthermore, a one-way valve which can be opened on the inside of the content-removing part can also be disposed at the opening, and when the piston moves to the opening, the one-way valve is pressed to close the opening. When the one-way valve is pressed to close the opening, closing the opening is more complete and instantaneous. The one-way valve and the piston can function synergistically.

Furthermore, the opening can be a gap between the content-removing part and the outflow channel, the content-removing part or the pressure transmitting channel has an extendable portion, and when the pressured is applied, the extendable portion is extended to close the gap. A gap between the content-removing part and the outflow channel allows the content to enter the content-removing part more conveniently and completely. In particular, when the pressure is applied, a paste with high viscosity or consistency can be incorporated into the content-removing part without moving, and can be removed after the opening is closed. The gap can be regarded as the closed opening disposed on the content-removing part under pressure.

Furthermore, the opening is a gap between the content-removing part and the outflow channel, a sleeve coupled with the piston is disposed in the content-removing part, and the sleeve can close or open the gap through the sliding of the piston. Similarly, in the implementation, when the pressure is applied, the sleeve can smoothly incorporate the content between the content-removing part and the outflow channel into the content-removing part, and the content is not required to move. After incorporated into the content-removing part, the content is easily removed. Similarly, the gap can be regarded as the closed opening disposed on the content-removing part under pressure.

In an embodiment of the present invention, the apparatus for removing the content comprises a branch tube, an end of the branch tube is connected to the upstream of the content-removing part, the pressurizing part or the pressure transmitting channel, the other end is connected to the mobile device, and the mobile device can open or close the opening with the positive change or the negative change of the pressure in the branch tube. Closing or opening the opening through the branch tube can reduce the components in the pressure transmitting channel, the content-removing part, or the outflow channel, simplify the internal structure thereof, decrease the pressure drop the process of removing the content, and allow the content to remove more easily.

The branch tube is directly connected to the upstream of the content-removing part, the pressurizing part or the pressure transmitting channel in order to reduce the pressure drop, so that the apparatus responds to the pressure change as soon as possible, and closes the opening before the content in the content-removing part flows out of the opening as early as possible.

In an embodiment of the present invention, the mobile device can surround the opening, and can expand or contract with the positive change or negative change of the pressure in the branch tube. When the mobile device expands, the opening is closed. When the mobile device contracts, the opening is opened.

In an embodiment of the present invention, the mobile device can be an elastic balloon located on a side of the plug which closes the opening. The elastic balloon can contract due to the pressure change of the space to which the elastic balloon is connected. When the pressure is applied, the elastic balloon expands, and the plug is pushed to the opening and closes the opening. When the pressure is not applied, or is negative, the elastic balloon contracts, and the plug is pulled back and opens the opening.

In an embodiment of the present invention, the mobile device can be the piston located in the branch tube, and when the pressure is applied, the piston or a sliding plate driven by the piston closes the opening. When the piston itself closes the opening, the piston can be located in a place corresponding to the opening of the external content-removing part. When the sliding plate driven by the piston closes the opening, the sliding plate can be located on the wall or on the inner side of the wall of the content-removing part. The sliding plate closes the opening through the movement parallel to the wall of the content-removing part (vertical with respect to the channel of the opening).

In an embodiment of the present invention, the apparatus can also comprises a groove on a wall of the content-removing part adjacent to the opening, the mobile device is a sliding plate in the groove, and the bottom of the groove is connected to the branch tube. The sliding plate extends or returns due to the pressure change of the space connected to the bottom of the groove. When the pressure is applied, the pressure in the groove increases, and the sliding plate is squeezed to slide out. When the pressure is not applied or is negative, the pressure in the groove decreases, and the sliding plate slides back to the groove.

In an embodiment of the present invention, the opening can be a gap between the content-removing part and the outflow channel, and the mobile device connected to the branch tube is a ring wall of the pressure transmitting channel or the content-removing part, and expands or contracts with the pressure changes, so as to close or open the opening.

The opening can be a gap between the content-removing part and the outflow channel, allowing the content to enter the content-removing part more conveniently or completely. In particular, when the pressure is applied, a paste with high viscosity or consistency can be incorporated into the content-removing part without moving, and can be removed after the opening is closed.

Moreover, the inside of the content-removing part and/or the pressure transmitting channel of the apparatus is provided with a piston which can move forward or backward along the content-removing part and/or pressure transmitting channel, and the piston is provided with a reposition element, so that the piston can return to a starting position after the pressure is no longer applied. This facilitates the reposition and the recovery function, and allows the apparatus to be reused.

Furthermore, a blocking element is disposed at a place with a specific distance from a rear section of the content-removing part and/or the pressure transmitting channel for preventing the piston from exceeding the place, so that every time the pressure is applied, the excessive amount is not removed, and only the same volume of the content is removed. Thus, the apparatus has the function of removing the content quantitatively.

For the apparatus, the inside of the content-removing part and/or a pressure transmitting channel is provided with a piston which can move forward or backward along the content-removing part and/or pressure transmitting channel, the pressure transmitting medium is on a side of the piston, and the content is on the other side thereof. Using the piston to transmit the pressure can separate the interfaces of the pressure transmitting medium and the content clearly, preventing contamination or air leakage.

For the apparatus, the inside of the outflow channel can be provided with a one-way valve to prevent the content from flowing back. The one-way valve is disposed on the piston which can slide toward a side the content-removing part within a range along the outflow channel, and an elastic part is disposed to pull to slide the piston toward a side of the content-removing part and return to a starting position. The one-way valve is disposed on the piston which can slide toward a side the content-removing part within a range along the outflow channel, preventing a situation in which the opening can not be opened, the content in the container cannot enter the content-removing part, and the pressurizing part and pressure transmitting medium cannot return to the start position due to the piston being in the content-removing part or other restrictions after the content is removed. It also prevents the content in the outlet of the outflow channel from being dripped outside the container and causing pollution. The fact that the piston returns to the starting position allows more content to enter the content-removing part or enter the outflow channel or the pressure transmitting channel through the content-removing part, so that there is a fixed starting position in the process of removing the content for the next time, which is favorable to accomplish removing the content quantitatively.

For the apparatus, a ring wall of the content-removing part or the outflow channel has a function of extending axially toward a side of the pressure transmitting channel within a limited extent and retracting after extending. The ring wall is located between the device, which prevents the content from flowing back into the outflow channel, and the piston, which is in the content-removing part, and the piston is preferably at the junction of the content-removing part and the outflow channel. The purpose of ring wall is to prevent a situation in which, after the content is removed, although the pressurizing part has negative pressure, the opening can not be opened, the content in the container cannot enter the content-removing part, and the pressurizing part and pressure transmitting medium cannot return to the start position due to the piston or other restrictions. When the content-removing part has negative pressure, the ring wall is extended, so as to eliminate the piston or other restrictions and open the opening smoothly. After the opening is opened, the ring wall retracts to return to the original shape thereof, which is favorable for allowing the content to enter smoothly.

For this apparatus for removing the content in accordance with the embodiment of the present invention, the pressure transmitting channel, the content-removing part, or the outflow channel is made from a transparent material marked with the scale of the volume or the length of the content flowing out, allowing the content to remove quantitatively and intuitively.

For the apparatus for removing the content in accordance with the embodiment of the present invention, the pressure transmitting medium in the pressurizing part and/or the pressure transmitting channel is a liquid, and a wall of the pressing part and/or pressure transmitting channel is marked with a scale for indicating the volume of the liquid flowing out when the pressure is applied. Due to the incompressibility of liquid, it is ensured that the volume of the liquid flowing out of the pressure transmitting channel is equal to the volume of the content flowing out of the outflow channel. The scale facilitates the accomplishment of removing the content quantitatively based on the needs of the user.

Furthermore, the pressurizing part is a straight tube and applies the pressure through the piston, an outer wall thereof is marked with a scale from a starting position of the piston to the pressure transmitting channel. It is easy to obtain the content, and the content is removed quantitatively and intuitively.

The apparatus for removing the content in accordance with the embodiment of the present invention for removing the content from the container has a simple structure, is easy to use, and has a wide range of applications. The amount which is removed by applying the pressure a single time can be large, or can be small. It can be removed based on experience or removed quantitatively. It can be used both in a container with an opening and a sealed container. It can also be used for normal liquids, viscous liquids, or pastes.

The present invention also provides a container having the structure of the apparatus for removing the content. The container used in daily life for removing the content from the container comprises a main body of the container, a pressure transmitting channel, a pressurizing part for applying pressure to the inside of the pressure transmitting channel through a pressure transmitting medium in the pressure transmitting channel to transmit the pressure which is applied by the pressurizing part, and an outflow channel for allowing the content to flow out and preventing the content from flowing back, wherein a content-removing part is located on the bottom of the container between the pressure transmitting channel and the outflow channel, and is provided with an opening connected to the main body of the container, the moving direction of a mobile device, which can open or close the opening, is vertical to the channel of the opening, when the pressurizing part applies the pressure, the opening is closed under the pressure, the content in the content-removing part flows out through the outflow channel under the pressure transmitted from the pressure transmitting medium in the pressure transmitting channel, and the pressurizing part, the outflow channel, or the content-removing part is provided with a reposition device and/or an elastic recovery function so that after the pressure is no longer applied, the pressure transmitting medium flows back to the same position as it was in before the pressure was applied. The reposition device and/or the elastic recovery function allows the pressure transmitting medium to flow back in the pressure transmitting channel or the pressurizing part, so that the negative pressure generated in the content-removing part makes the content in the container conveniently enter the content-removing part.

The specific technical solutions of the apparatus for removing the content described above can also be applied to the container, and are not described redundantly.

The container overcomes many problems of containers in the prior art, and has the following advantages:

(1) It conveniently removes the content. Since the content-removing part is located on the bottom of the container, even if there is little left in the container, the content still can be removed as conveniently as before.

(2) It prevents contamination. When the apparatus removes the content, the container is not required to be inverted, and air, germs, and particles do not frequently contact the content, preventing the content from being contaminated.

(3) The content is precisely removed. Since the pressure is only applied to a part of the content, and the direction in which the pressure applied is the same as the direction in which the content is flowing out, the strength needed for applying the pressure is little, the content is removed precisely and quantitatively, and the pressure requirements of a sprayer and a foam-generating device are met.

(4) The structure is simple and practical, and is not easily damaged.

(5) It has a wide range of uses, and can be used when the content has a high viscosity or consistency.

The main body of the container can be provided with an inlet for outside air. The inlet is an air filtering, purifying, or deoxygenating device, or an inner side of the inlet close to the main body of the container is provided with an inflatable air-collecting device. This prevents the content from contacting various outside harmful substances and deteriorating due to contamination and oxidation.

The main body of the container can be compressed atmosphere. If the wall of the main body of the container can be compressed, when the content in the container is reduced, atmosphere outside compresses the main body of the container, so as to reduce the volume of the container, balance the external pressure and the internal pressure of the main body of the container, and remove the content continuously. Since the volume of the main body of the container is actively reduced, there is no chance that outside air and impurities enter the main body of the container. This completely prevents the content from being contaminated, oxidized, or deteriorating due to outside gas or impurities.

For the container, the pressurizing device is an elastic balloon which has only one opening connected to the pressure transmitting channel. The elastic balloon which has only one opening can have a pressurizing function when applying the pressure. When the removal of the content is complete, negative pressure is created spontaneously, so that the content flows into the content-removing part, thereby allowing it to be conveniently removed next time. This provides convenience for liquids with high viscosity and consistency to enter the outflow channel.

For the container, the content-removing part is located in a circumferential groove on the bottom of the main body of the container. The arrangement allows the content to be removed smoothly, even if there is little left in the container, and is convenient for the user to observe the condition in which the content enters the content-removing part and flows out.

For the container, the outlet of the outflow channel is provided with a spraying device or a foam-generating device. Since the pressurizing part can apply greater and continuous pressure, and the pressure acts directly on the liquid in the channel, a longer and continuous duration of spraying or generating foam is obtained in use.

For the container, the main body of the container is provided with a pressurizing device for applying the pressure to the content in the main body of the container. The pressurizing device, which is disposed on the main body of the container and applies the pressure to the content in the main body of the container, allows the content to enter the content-removing part more conveniently through active pressurization, which is favorable to removing content with greater viscosity and consistency.

The container overcomes many problems of containers in prior art, and has many advantages. For example, the container removes the content conveniently and precisely, prevents contamination, has a simple structure, is not easily damaged, and has a wide range of usages. Moreover, the container has the characteristics of a greater volume and reusability, which reduces the uses of plastic packages, and is reduces pollution in the environment.

The present invention also provides a method in daily use for removing the content from the container. A method in daily use for removing the content from the container, comprising steps of applying pressure to the inside of a pressure transmitting channel by using a pressurizing part for removing a pressure transmitting medium in the pressure transmitting channel, so that an opening of a content-removing part in a main body of the container is closed through the movement of a mobile device whose moving direction is vertical to the channel of the opening, and the content in the content-removing part is moved along the outflow channel through the pressure transmitting medium; and stopping the pressurizing part from applying the pressure, after the removal of the content is complete, so that the content in the content-removing part ceases flowing out, the pressurizing part, the pressure transmitting channel, or the content-removing part returns to a starting position and/or elastically recovers, the pressure transmitting medium flows back along the pressure transmitting channel, the opening of the content-removing part in the main body of the container is opened through the movement of the mobile device whose moving direction is vertical with respect to the channel of the opening, and the content in the main body of the container from the opening of the content-removing part in the main body of the container enters the content-removing part.

In accordance with the embodiment of the present invention, in the method above for removing the content, the end of the process of removing the content is determined based on the position of an indicating device. The pressure transmitting channel, the content-removing part, or the outflow channel is provided with a device indicating a distance of the content flowing out, for indicating a volume of the content flowing out, and when the volume of the content flowing out equals to the volume needed, the pressure is no longer applied, and the removal of the content is complete. The device typically is a piston which can be seen from outside for accomplishing removing the content quantitatively based on the needs of the user.

In accordance with the embodiment of the present invention, in the method above for removing the content, the mobile device is a piston in the pressure transmitting channel or the content-removing part, or a mobile part connected to the branch tube, and the branch tube is connected to the pressurizing part or the pressure transmitting channel.

This method for removing the content from the container has simple procedures, is easy to operate, has precise quantification, can be reproducible, and is suitable for daily needs.

The present invention relates to the apparatus removing the content from the container, the container in which the apparatus is used, or the method for removing the content from the container as described above are being applied to the field of food, daily chemical products, disinfection products, pharmaceutical products. The applications can meet the requirements of easy operation, precise quantification, and high reproducibility in these fields and some of the technical solutions thereof can prevent the products in these field from being contaminated, oxidized, deteriorating, or volatized.

The apparatus, the container and the method for removing the content from the container provided by the present invention prevent the content from deteriorating and being contaminated, and accomplish removing the content quantitatively. The content removed each time is not more than or is equivalent to a predefined amount, which avoids waste and pollution in the environment due to the excess content removed. Since it is suitable for a container with larger volume, and can be reused, it is favorable to reduce various package waste in the environment, especially plastic packages.

DETAILED DESCRIPTION OF THE PREFERRED EMBODIMENTS

First Embodiment

Figure 1:
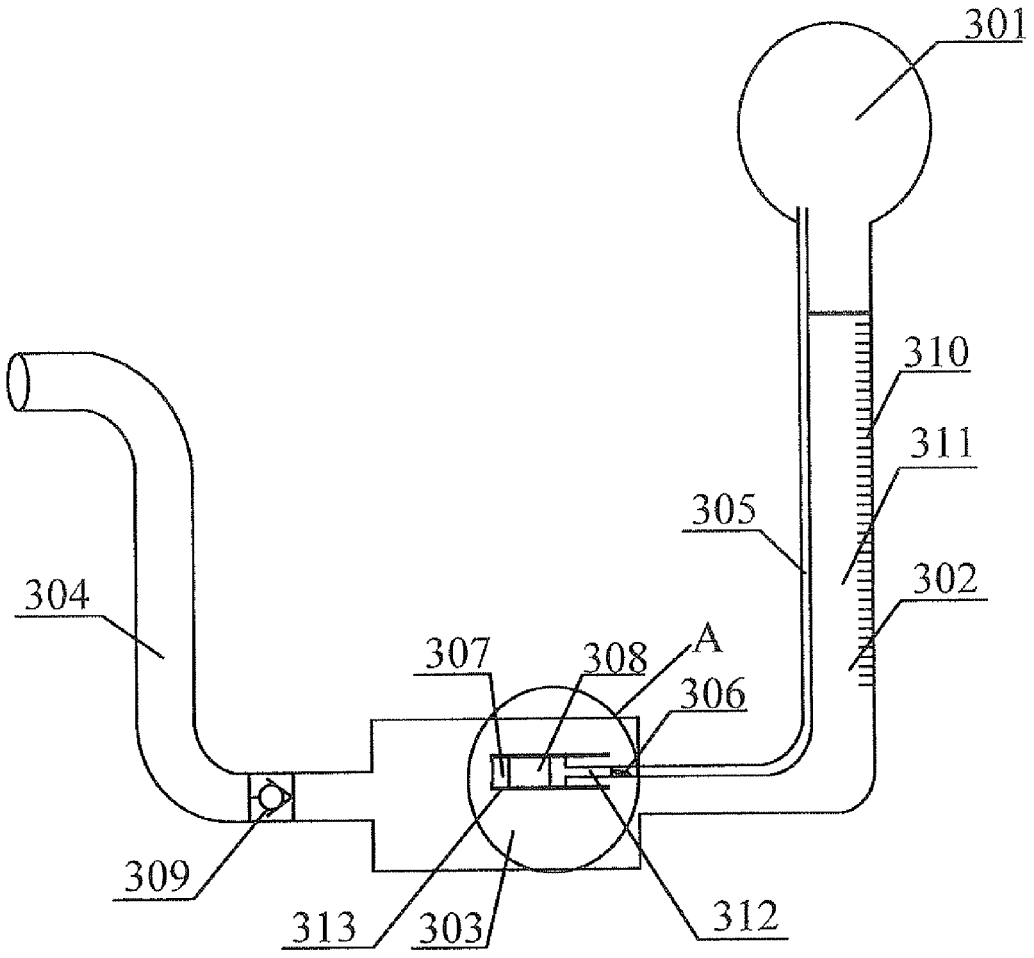
FIG. 1 is a schematic diagram of a structure of an apparatus in a first embodiment.
Figure 2:
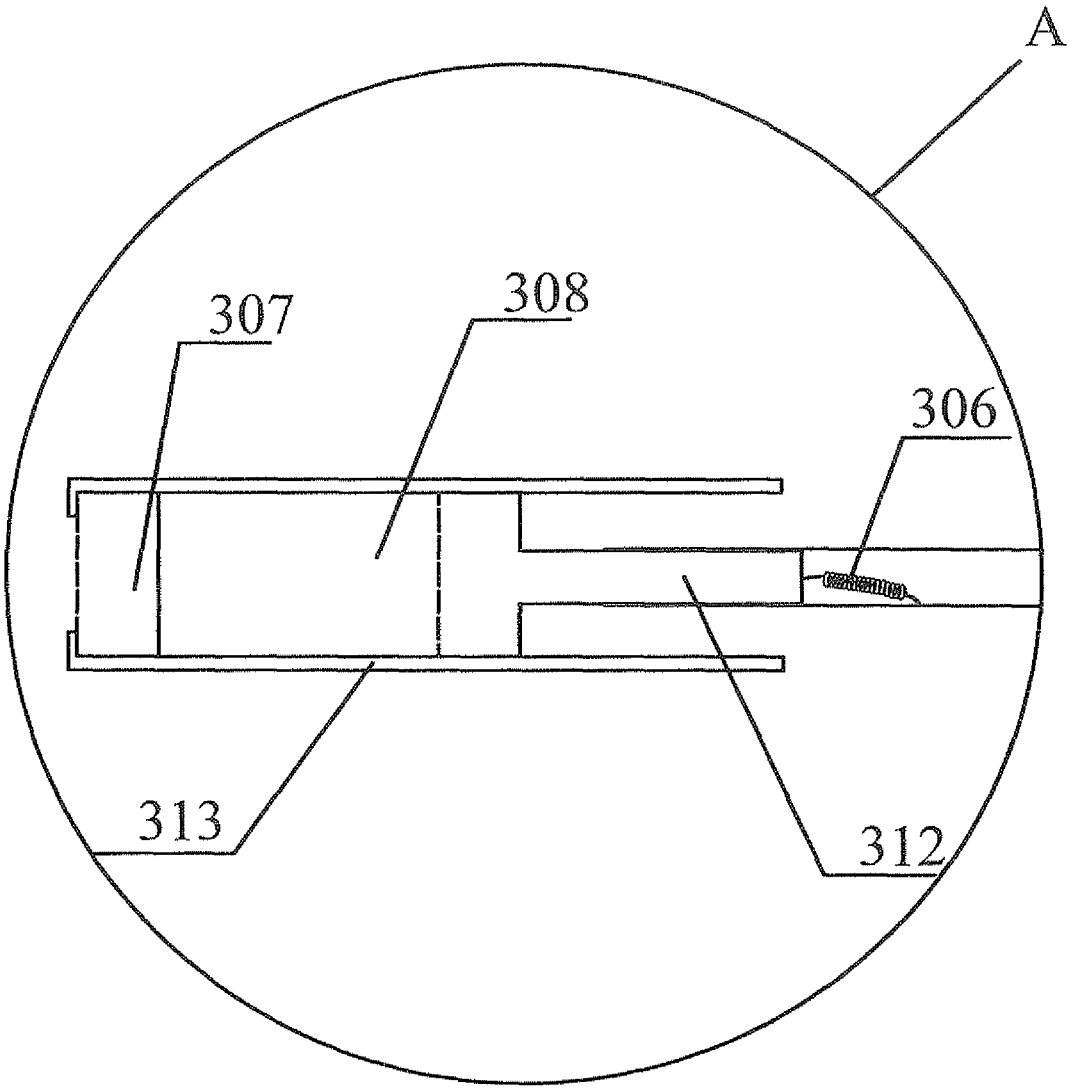
FIG. 2 is an enlarged diagram of part A of FIG. 1.

FIG. 1 and FIG. 2 show an apparatus removing content conveniently in accordance with a first embodiment of the present invention. FIG. 2 is an enlarged diagram of part A in FIG. 1. The apparatus includes a pressurizing balloon 301, a pressure transmitting channel 302, a content-removing part 303, and an outflow channel 304. The pressurizing balloon 301 has only two openings connected to the pressure transmitting channel 302 and the controlling airway 305. The pressurizing balloon 301 has a shape recovery function, which can rebound after the pressure is no longer applied, so that the negative pressure can be generated in that pressure transmitting channel 302 and the controlling airway 305.

The pressure transmitting medium 311 in the pressure transmitting channel 302 is the content. The pressure transmitting channel 302 and the content-removing part 303 are connected. The wall of the pressure transmitting channel 302 is marked with a scale 310, indicating the volume of the pressure transmitting medium 311 flowing out of the pressure transmitting channel 302 when the pressure is applied. The volume flowing out is also the volume of the content flowing out of the outflow channel 304.

The inner wall of an end of the controlling airway 305 is connected to the elastic part 306, an opposite end of the elastic part 306 is connected to a shaft 312 of a sliding plate 308, and the shaft 312 is located at the end of the controlling airway 305, can freely slide, and seals air in the controlling airway 305. There is an opening 307 on the side wall of the content-removing part 303. There are slideways 313 on the both sides of the opening 307 on the side wall of the content-removing part 303. The sliding plate 308 can slide along the slideways in the slideways 313.

The outflow channel 304 is connected to the content-removing part 303, and provided with a one-way valve 309 inside.

When the apparatus is used to remove the content, the pressurizing balloon 301 is squeezed, air reaches the shaft 312 through the controlling airway 305 and pushes the sliding plate 308 to slide along the slideways 313 through the shaft 312, and then the sliding plate 308 moves to the left and closes the opening 307. The pressure closing the opening 307 is the pressure difference between the pressurizing part 301 and the content outside the content-removing part 303. The pressure is applied to the pressure transmitting channel 302, so as to move the pressure transmitting medium 311 (which is the content) downward, and allow the content to flow out through the content-removing part 303 and the outflow channel 304.

After the needed volume is removed, the balloon 301 is no longer squeezed, and recovers the shape thereof, so as to generate the negative pressure. Since the pressure in the controlling airway 305 decreases, and the elastic part 306 retracts, the shaft 312 is retracted. The sliding plate 308 slide along the slideways 313 to the right to open the opening 307. The pressure transmitting medium 311 in the pressure transmitting channel 302 flows back under negative pressure, the valve 309 is closed, and the content in the main body of the container enters the content-removing part 303 through the valve 307. The pressure transmitting medium 311 in the pressure transmitting channel 302 returns to the same position as before the pressure was applied. The apparatus is ready to remove the content for the next time.

Second Embodiment

Figure 3:
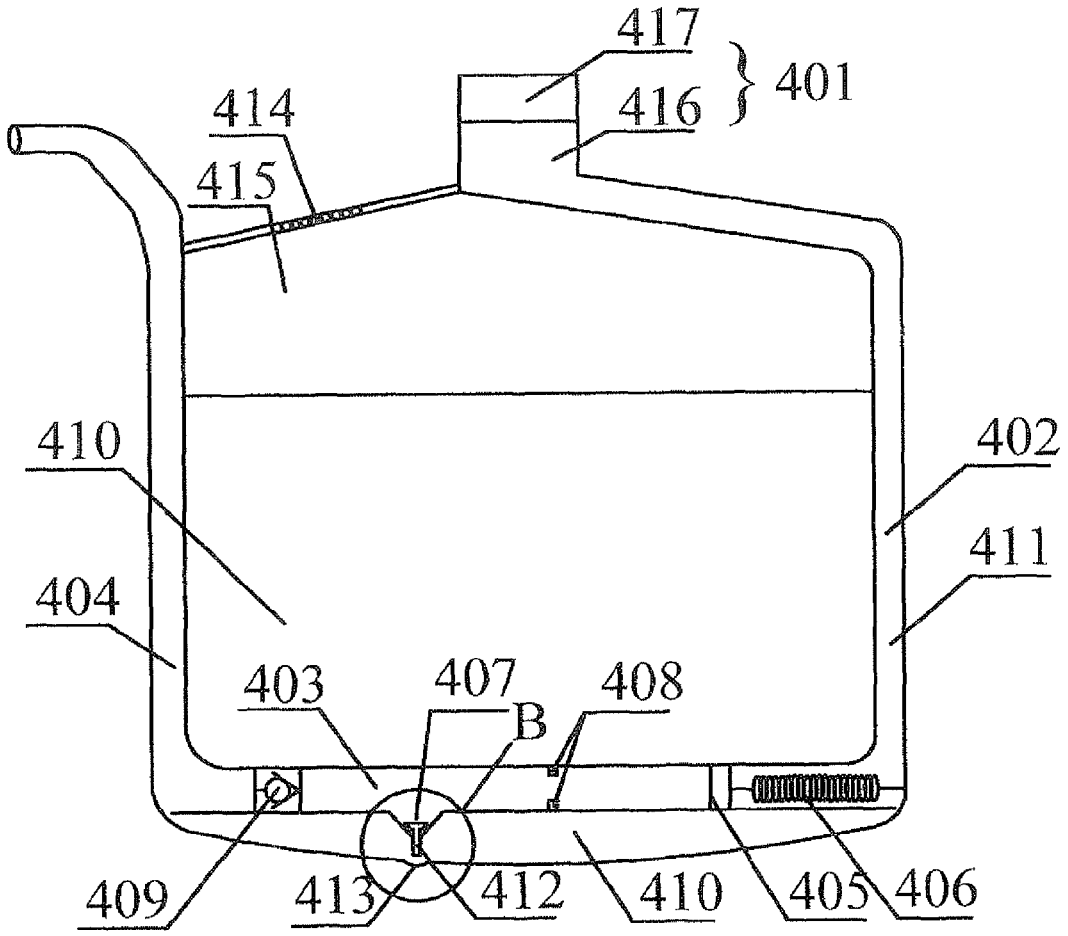
FIG. 3 is a schematic diagram of a container of an apparatus in a second embodiment.
Figure 4:
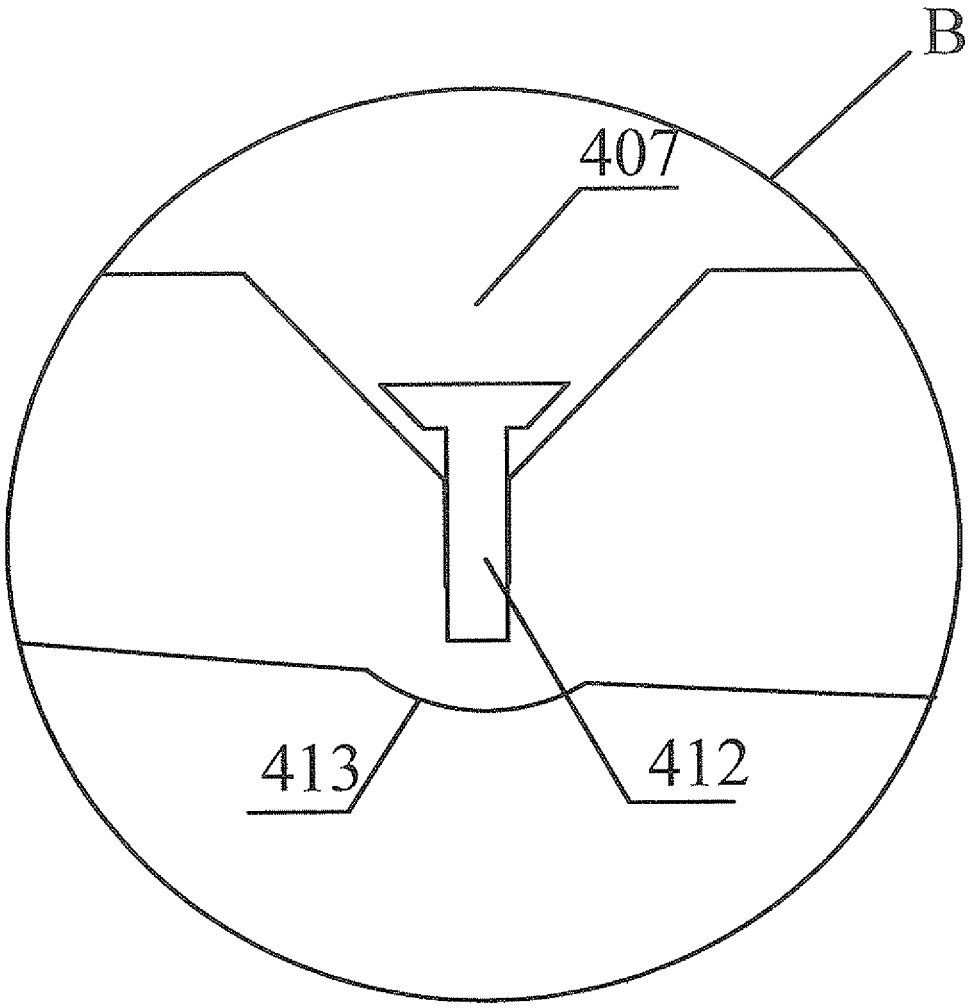
FIG. 4 is an enlarged diagram of part B of FIG. 2.

FIG. 3 shows a container removing the content conveniently in accordance with a second embodiment of the present invention. FIG. 4 is an enlarged diagram of part B in FIG. 3. The container includes a main body 415 of the container provided with an opening 414. A device is used to close the opening, which prevents germs and dust from entering the opening 414 after the container is filled, but allows a small amount of air to enter the opening 414. For example, the device includes a porous body or a filter. The pressurizing part 401 includes a pressurizing chamber 416 and a piston 417 which is located on the pressurizing chamber 416 and can move upward and downward. The piston 417 seals the pressurizing chamber, and a part thereof is exposed from an upper part of the pressurizing chamber 416. The pressurizing chamber 416 is connected to the pressure transmitting channel 402, and both are filled with the same liquid 411. The pressure transmitting channel 402 is provided with the piston 405, and the piston 405 can move in the space of a part of the pressure transmitting channel 402 and the content-removing part 403. The liquid 411 (pressure transmitting medium) is on the right side of the piston 405, the content 410 is on the left side, and a spring 406, one of whose end is fixed on an inner wall of the pressure transmitting channel 402, is connected to the right side.

A specific position on the left side of the piston 405 in the content-removing part 403 is provided with a blocking part 408, which prevents the piston 405 from removing left after the piston 405 arrives in the position under the pressure. The lower part of the content-removing part 403 is provided with the opening 407. The plug 412 is disposed in the opening 407. When the plug 412 falls in the opening 407, the opening 407 is sealed. The plug 412 has a longer end for preventing from leaving the position in which the opening 407 is located when the plug 412 is raised up. The opening 407 is located in the recess 413 on the lowest bottom of the main body 415 of the container.

The outflow channel 404 is provided with an outward one-way valve 409.

When the container is used, every time the piston 417 is pressed down, the specific volume of the content is removed. The specific operation is as follows:

The piston 417 is pressed, the liquid 411 in the pressurizing chamber 416 and the pressure transmitting channel 402 is moved under the pressure and then pushes the piston 405 to the left, the plug 412 blocks the opening 407 under the pressure, and the piston 405 pushes the content 410 in the content-removing part 403 along the outflow channel, 404 to flow out. The pressure which closes the opening 407 is the pressure difference between the internal and external content in the content-removing part 403. When piston 405 moves to the position in which the blocking part 408 located, the piston 405 is stopped from removing, the content 410 in the content-removing part 403 stops flowing out. The outflow volume is the volume of the content between the piston 405 before the pressure was applied, and the blocking part 408.

When the pressure is no longer applied to the piston 417, the piston 405 returns to the original position due to the effect of the spring 406, and the piston 417 and the liquid 411 is pushed and returns to the original position. Since the valve 409 is closed, the negative pressure is generated in the content-removing part 403, and the plug 412 is raised up and opened, the content 410 in the main body 415 of the container enters the content-removing part 403 along the opening 407. The equal volume of external air to the volume of the content removed enters the upper part of the container through the opening 414, and the internal pressure and external pressure is gradually balanced. The container is ready to remove the content for the next.

Third Embodiment

Figure 5:
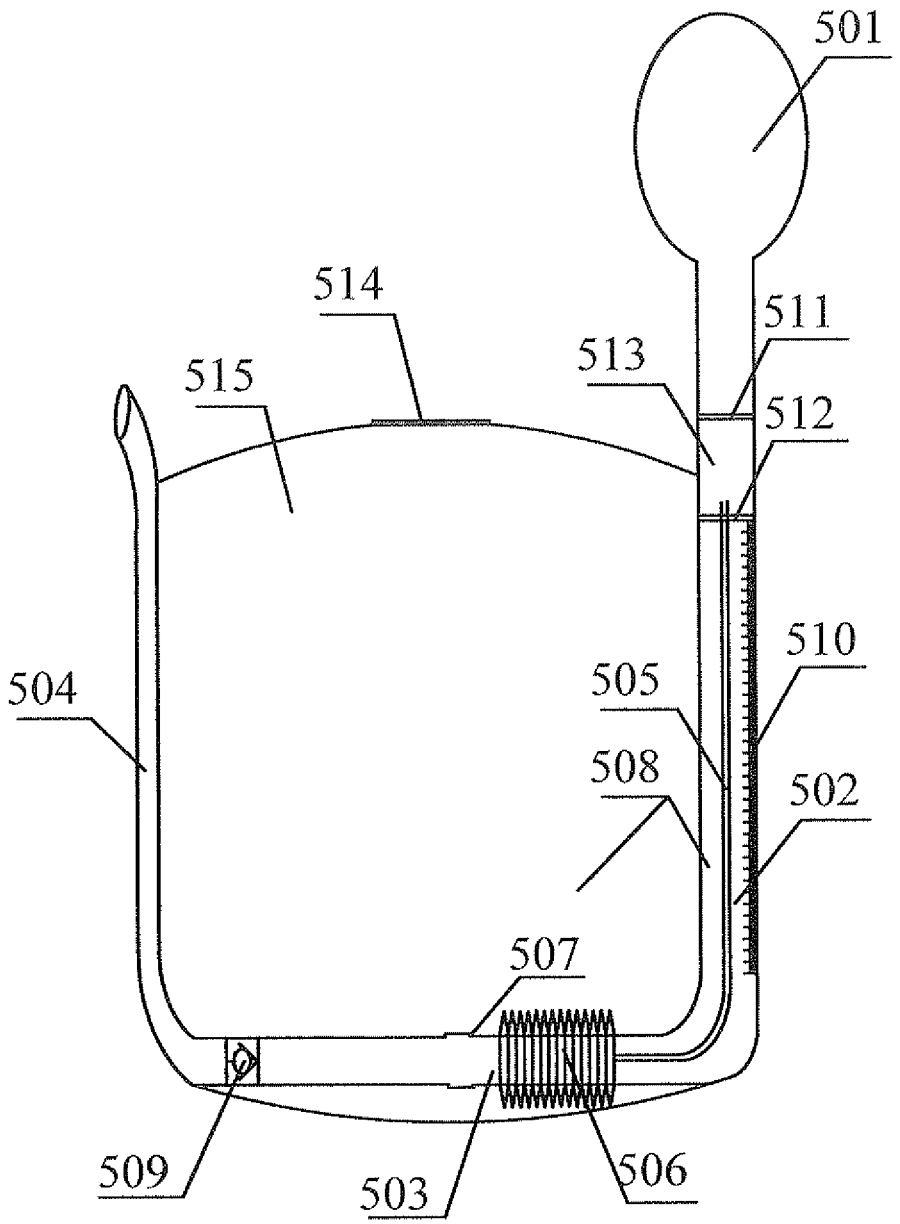
FIG. 5 is a schematic diagram of a container of an apparatus in a third embodiment.

FIG. 5 shows a container removing the content easily, according to a third embodiment. The container includes a main body 515 of the container, and is provided with an opening 514 on the top thereof. After the content 508 is filled in the container, the opening 514 is closed, no substance is allowed to enter the main body 515 of the container body. An upper part of the main container 515 of the container is formed from a soft material. The volume of the main body 515 decreases with the decrease of the volume of the internal content under the effect of the atmosphere.

The pressurizing balloon 501 only has an opening connected to the pressure transmitting channel 502. The pressurizing balloon 501 has a shape recovery function, and can rebound after the pressure is no longer being applied, so as to generate negative pressure in the pressure transmitting channel 502. There are two pistons (a piston 511 and a piston 512) in the pressure transmitting channel 502. The pressure transmitting medium 513 is between the two pistons. The pressure transmitting medium 508 is under the piston 512, and is the content 508. The friction between the piston 511 and the pressure transmitting channel 502 is less than the friction between the piston 512 and the pressure transmitting channel 502. When the pressure is not applied, the position where the piston 512 is located is the starting position, and is marked with a scale 510, which is downward, for indicating the volume of the content from the piston 512 thereto. The branch tube 505 is located in the pressure transmitting channel 502, and connected to the pressure transmitting medium 513 through the piston 512 and an expandable multi-ring-shaped balloon 506. The multi-ring-shaped balloon 506 is located at the rear end of the pressure transmitting channel 502, and connected to content-removing part 503. The multi-ring-shaped balloon 506 is expanded after the pressure transmitting medium 513 is filled therein, and contracts when the pressure is not applied.

When the multi-ring-shaped balloon 506 is not expanded, there is an opening/gap 507 between the content-removing part 503 and the outflow channel 504. When the multi-ring-shaped balloon 506 is expanded, the content-removing part 503 is pushed to the left, and connected to the starting end, and the opening/gap no longer exists between them. The outflow channel 504 is provided with a one-way valve 509 inside.

When the container removing the content is used, the pressurizing balloon 501 is squeezed, the piston 511 is moved down under the pressure, the pressure transmitting medium 513 between the piston 511 and the piston 512 goes through the branch tube 505 into the multi-ring-shaped balloon 506 under pressure, the multi-ring-shaped balloon 506 is expanded, the content-removing part 503 is pushed to the left, and connected to the starting end of the outflow channel 504, and the opening/gap 507 is closed. The pressure closing the opening/gap 507 is the pressure difference between the pressure transmitting medium 513 and the content outside the content-removing part 503. Subsequently, the transmitting medium 513 transmits the pressure from the piston 511 to the piston 512 and the pressure transmitting medium 508, and the content 508 in the content-removing part 503 flows out through the outflow channel under pressure. When piston 512 is moved to a target position, the pressure is no longer applied, and the content 508 no longer flows out.

When the pressurizing balloon 501 is stopped from being squeezed, the pressurizing balloon 501 rebounds, the piston 511 moves upward, the pressure between the piston 511 and piston 512 is lowered, the pressure transmitting medium 513 flows back, the multi-ring-shaped balloon 506 retracts, and the opening/gap 507 between the content-removing part 503 and the outflow channel 504 is opened.

Subsequently, the piston 512 is moved upward due to the negative pressure, and the pressure transmitting medium 508 is also moved upward. The valve 509 is closed. The content 508 in the main body of the container 515 enters the content-removing part 503 from opening 507. The pressurizing balloon 501 recovers, and the piston 511, the pressure transmitting medium 513, the piston 512, and the pressure transmitting medium 508 return to the position where they were located before the pressure was applied. The upper soft part of the main body 515 of the container falls down, so that the same volume of the main body 515 of the container which is reduced is equivalent to the volume of the content which is removed The internal pressure and external pressure of the main body 515 of the container are gradually balanced, and the container is ready to remove the content for the next time.

The method for balancing the internal and the external pressures of the container 515 further includes disposing a piston on the main body. After the content in the main body of the container is gradually removed, the piston is gradually moved inward into the main body of the container under the effect of the atmosphere, reducing the volume of the main body of the container.

A handle can also be disposed on the piston on the main body of the container, and the pressure is applied to the content in the main body of the container via the handle. The design not only maintains the balance of the internal and external pressures of the container after the content is removed, but also allows the content to enter the content-removing part.

Fourth Embodiment

Figure 6:
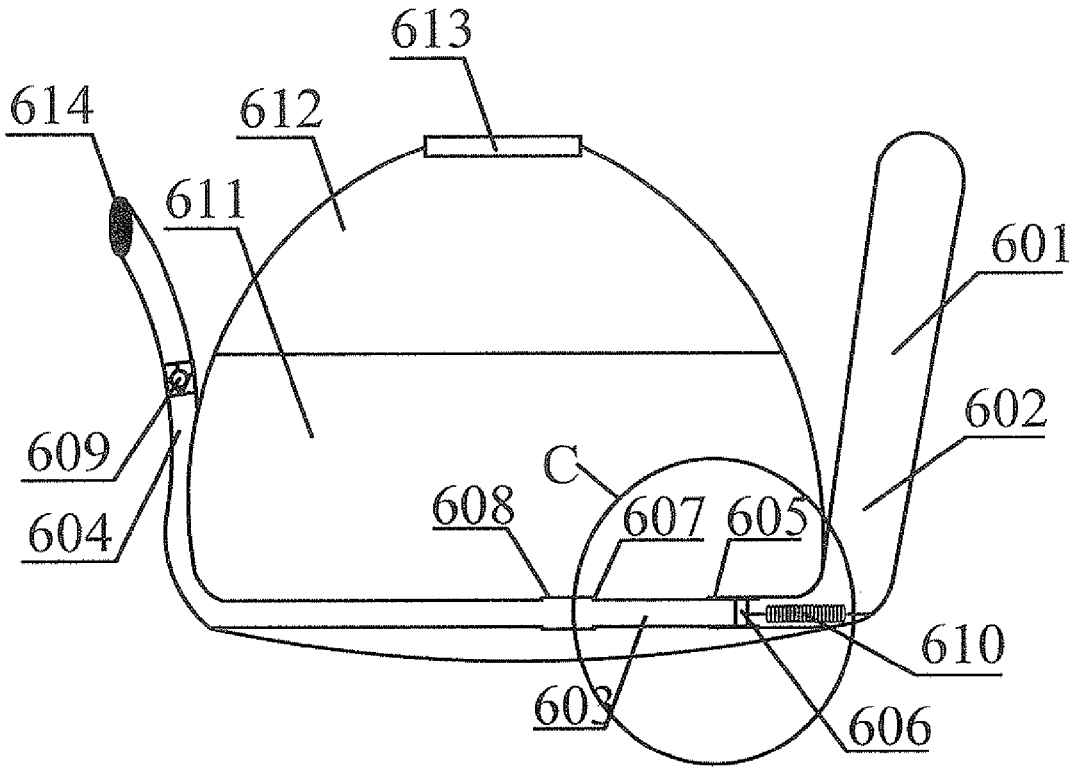
FIG. 6 is a schematic diagram of a container of an apparatus in a forth embodiment.
Figure 7:
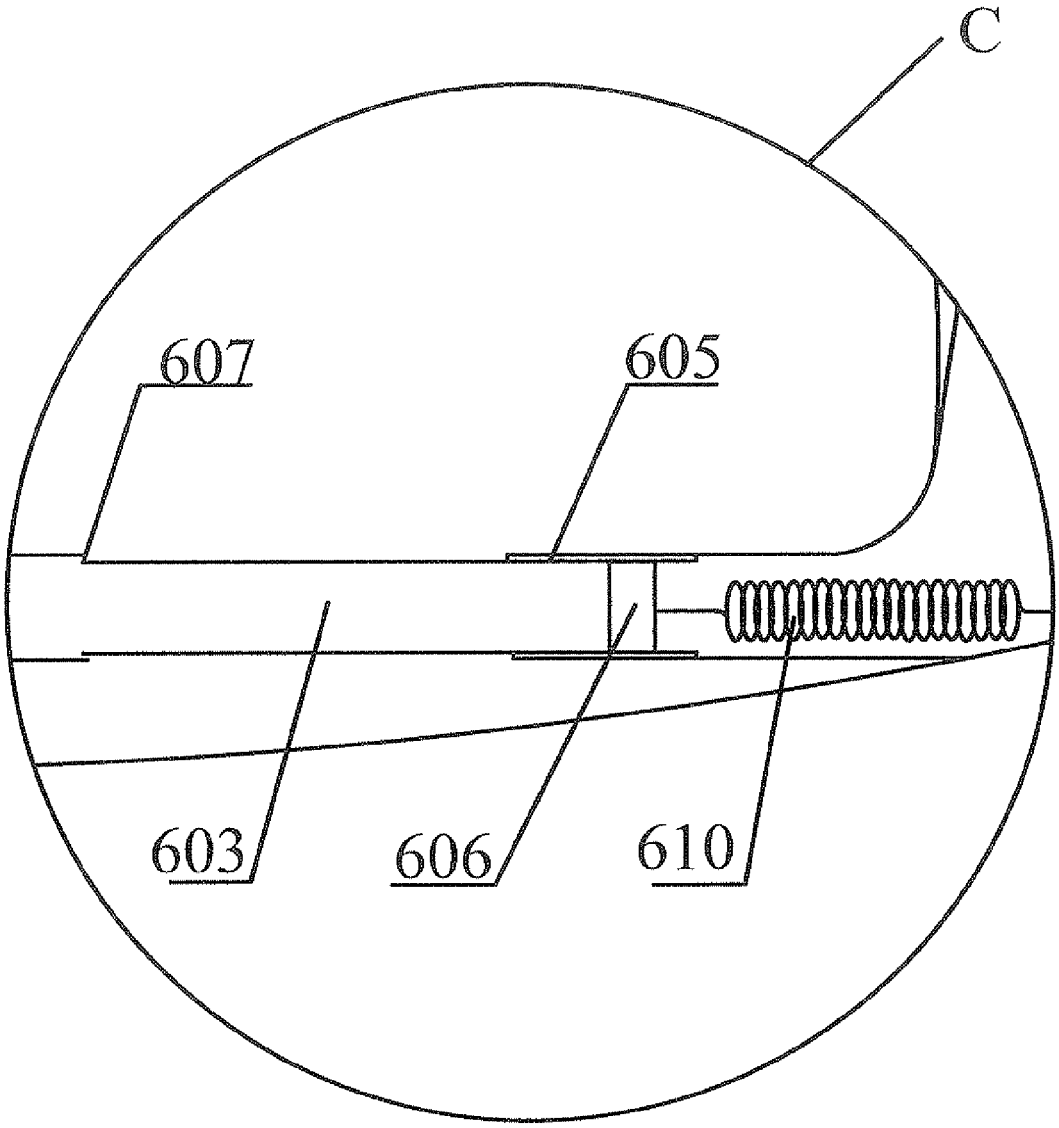
FIG. 7 is an enlarged diagram of part C of FIG. 6.

FIG. 6 shows a container for removing content easily according to a fourth embodiment. FIG. 7 is an enlarged diagram of part C in FIG. 6. The container includes a main body 612 of the container, and is provided with an opening 613 on the top thereof. The opening 613 is closed by a multilayered paper valve which allows a small amount of air to enter the opening unidirectionally. A pressurizing part 601 is an elongated elastic balloon, which is also a pressure transmitting channel, has only one opening connected to a content-removing part 603, and is filled with a pressure transmitting medium 602.

The content-removing part 603 is located on slideways 605, and can slide to the left and the right along the slideways. The slideways 605 are located on an inner wall of the rear end of the pressure transmitting channel. The place between the content-removing part 603 and the inner wall of the rear end of the pressure transmitting channel is sealed, so that no content and pressure transmitting medium 602 can pass. The piston 606 is located in the content-removing part 603, and can be moved to the left and the right in the content-removing part 603. The friction between the content-removing part 603 and the slideways 605 is less than the friction between the piston 606 and the content-removing part 603. The right end of the piston 606 is connected to an inner wall of the pressure transmitting channel through an elastic part 610. When the pressured is not applied, there is a gap between the content-removing part 603 and the outflow channel 604, which is an opening 607. When the pressured is applied, the content-removing part 603 slides out and is connected to a sleeve 608 of the starting end of the outflow channel 604, and the opening 607 is closed. The outflow channel 604 is provided with a one-way valve 609 inside, and an outlet is provided with a foam-generating device 614.

When the container is used to remove the content, the pressurizing balloon 601 is squeezed, and the pressure transmitting medium 602 therein is moved down under the pressure. The content-removing part 603 is moved to the left along the slideways under the pressure, and connected to the sleeve 608 of the starting end of the outflow channel 604 for closing the opening 607. The pressure is the pressure difference between the pressure transmitting medium 602 and the content. With the increasing pressure, the piston 606 is moved to the left under the pressure, and pushes the content 611 in the content-removing part 603 through the outflow channel 604 and the foam-generating device 614, which turns the content into foam to flow out.

When the pressurizing balloon 601 ceases being squeezed, the pressurizing balloon 601 rebounds, the pressure transmitting medium 602 moves upward, the content-removing part 603 and the piston 606 are moved to the right under the effects of the negative pressure and the elastic part 610, and the opening 607 between the content-removing part 603 and the outflow channel 604 is opened. The valve 609 is closed. The content 611 in the main body 612 of the container enters the content-removing part 603 from opening 607. The pressurizing balloon 601 recovers, and the pressure transmitting medium 602, the piston 606, and the content-removing part 603 return to the position where they are located before the pressure is applied. The volume of outside air equivalent to the content which is removed enters the main body of the container through the opening 613. The internal pressure and external pressure are gradually balanced, and the container is ready to remove the content for the next time.

Fifth embodiment

Figure 8:
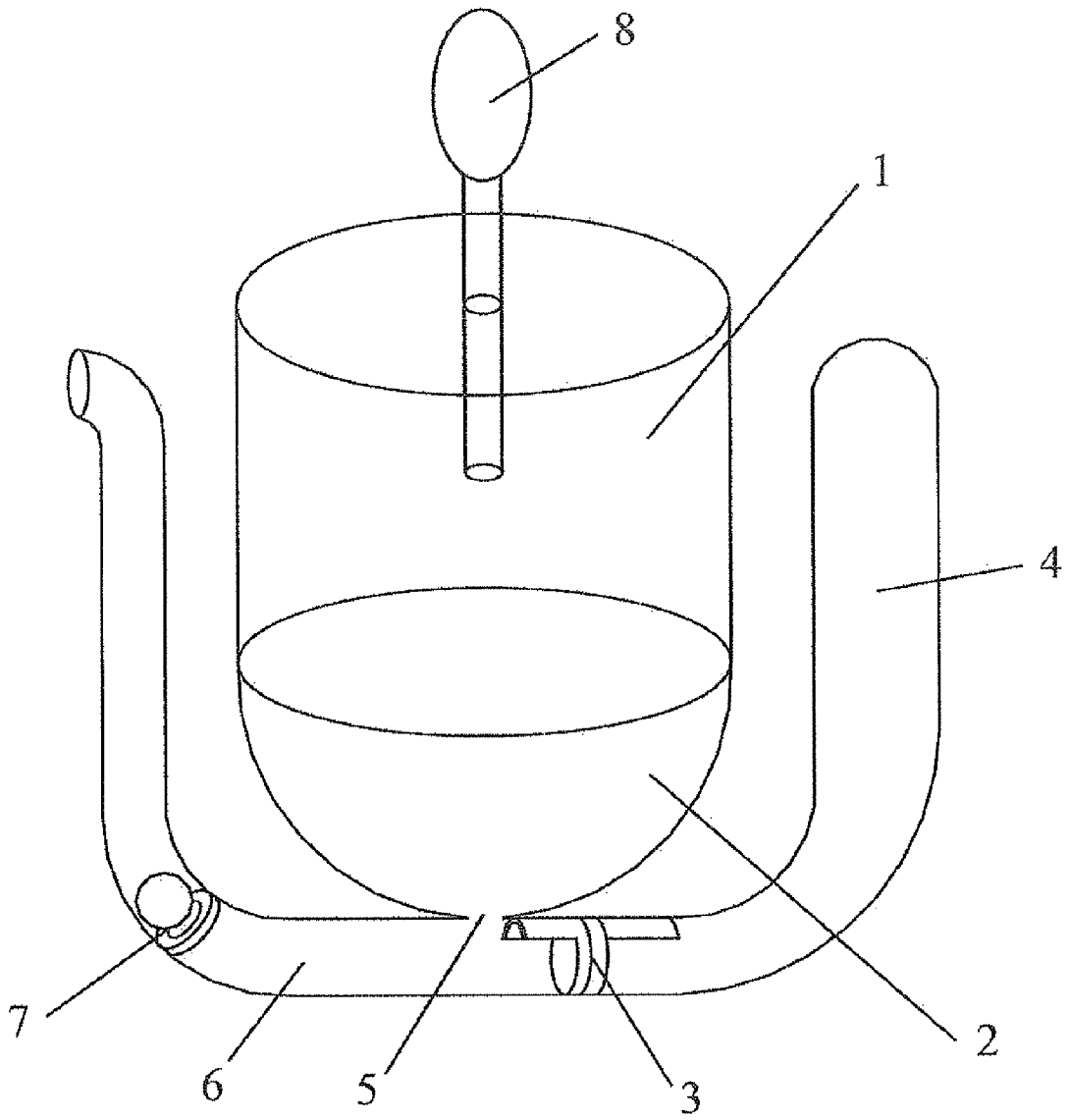
FIG. 8 is a schematic diagram of a container of an apparatus in a fifth embodiment.

FIG. 8 shows a container removing content easily, according to a fifth embodiment. It is a container containing a liquid content 2 with higher consistency, and includes a main body of the container 1, an outflow channel 6, and a tube 4 which can apply the pressure to the out flow channel 6 and is filled with water. The place between the tube 4 and the outflow channel 6 is provided with a piston 3, which can move to the left and the right and prevent water, liquid, or paste from passing through itself. The piston 3 has an elongated upper lateral circumferential wall. When the piston 3 and the elongated upper lateral circumferential wall is moved to the passage 5, the passage 5 is closed. The passage 5 is between the main body 1 of the container and the outflow channel 6. The water in the tube 4 presses the piston 4 to the left by squeezing the tube 4. The outflow channel 6 is provided with a one-way valve 7 for closing the outflow channel 5 to prevent the content 2 from flowing back when the pressure is not applied.

An air balloon 8 is disposed on the top 1 of the main part of the container. The outer end of the air balloon allows air to enter the air balloon, and the inner end allows air to exit from the air balloon. It can be used to apply the pressure to the air space continuously for pressing the content 2 into the outflow channel 6.

When the container is used to remove the content, the tube 4 is squeezed, so as to move the water therein to the direction of the outflow channel 6 and push the piston 3 to the left. When the upper lateral circumferential wall of the piston 3 is moved to the passage 5, Which connects the main body 1 of the container to the outflow channel 6, the passage 5 is closed. The content is moved outward and presses to open the one-way valve 7 to flow out. When the volume of the content reaches the user's required level, the tube 4 is no longer squeezed, and the tube 4 rebounds to generate the negative pressure, so that the piston is moved to the right and generates the negative pressure in the outflow channel 6, so as to close the one-way valve 7 and open the passage 5. The air balloon 8 is squeezed to apply the pressure to the inside of the main body 1 of the container, allowing the content 2 to enter the outflow channel 6. After the content 2 is filled with the outflow channel 6, the pressure is no longer applied, and the container is ready to remove the content for the next time.

Sixth Embodiment

Figure 9:
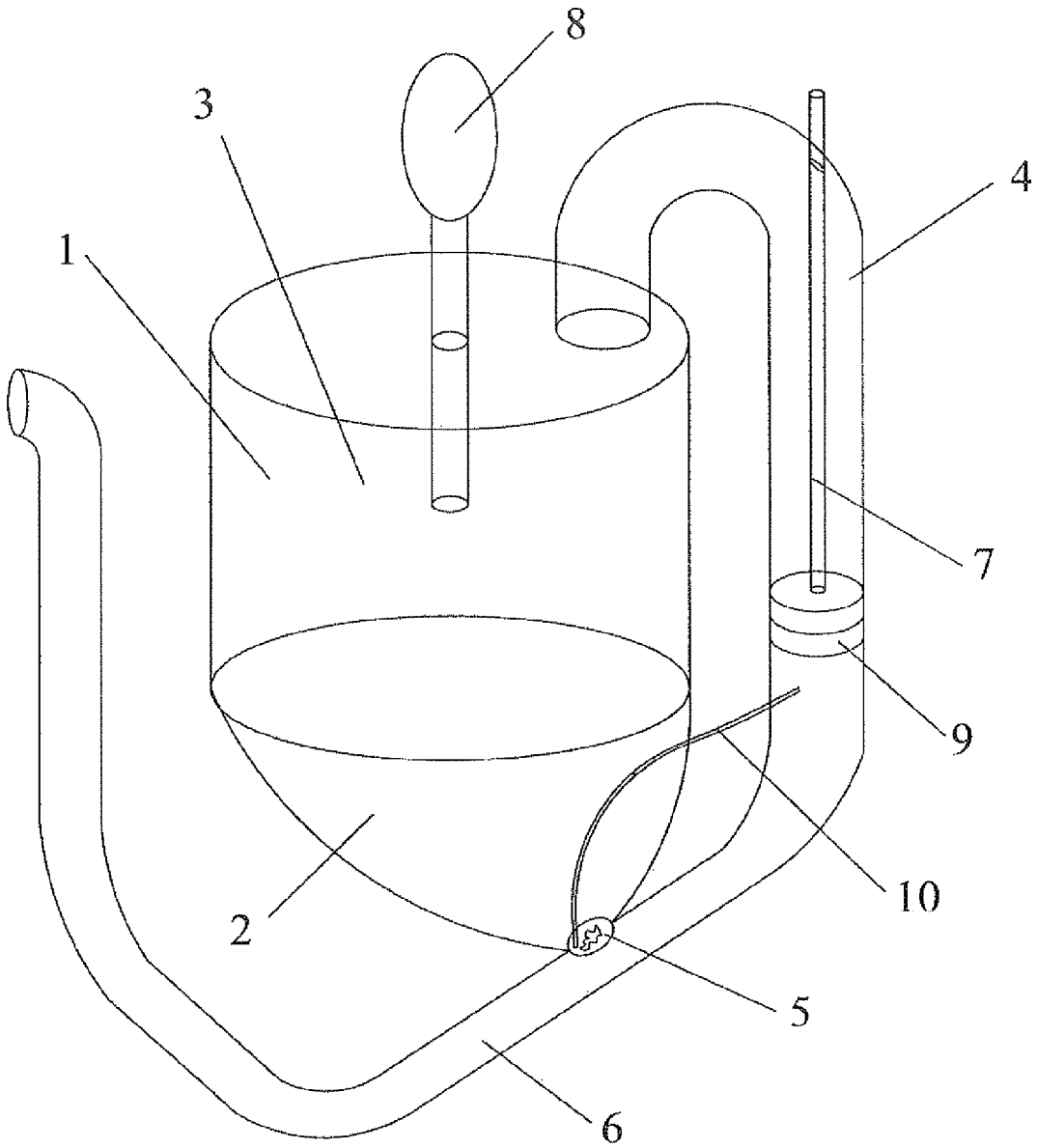
FIG. 9 is a schematic diagram of a container of an apparatus in a sixth embodiment.

FIG. 9 shows a container removing content easily, according to a sixth embodiment. It is a container containing paste 2, and includes a main body of the container 1, an outflow channel 6, and a pressurizing tube 4. The pressurizing tube 4 is provided with a piston 9 inside. The piston 9 divides the pressuring tube 4 into an upper part and a lower part. The upper part is connected to air space in the main body 1, and the lower part is connected to the outflow channel 6. The piston has a shaft 7 outside the pressurizing tube 4 for fixing. The piton 9 can be moved upward and downward through the shaft 7. The bottom of the main body 1 is connected to the outflow channel 6 through a part 5. The starting segment of the outflow channel 6 inclines downward, and allows the content 2 to enter.

The part 5 is a ring-shaped balloon, whose outer ring is connected to the junction of the bottom of the main body and the outflow channel 6. When not inflated, the balloon has an opening at the center, so as to connect the main body 1 to the outflow channel 6. When inflated, the balloon is expanded to close the opening at the center, so as to disconnect the main body 1 from the outflow channel 6. The air in the balloon is connected to the space below the piston 9 in the pressurizing tube 4 through a branch tube 10.

An air balloon 8 is disposed on the top 1 of the main part of the container. The outer end of the air balloon allows air to enter the air balloon, and the inner end allows air to exit from the air balloon. It can be used to apply the pressure to the air space continuously for pressing the content 2 into the outflow channel 6.

When the container is used to remove the content, the shaft 7 is moved downward, so as to move the piston 9 downward and apply the pressure the outflow channel 6. The branch tube 10 transmits the pressure to the balloon 5, so that the balloon 5 is expanded, and the main body 1 and the outflow channel 6 are disconnected. The content 2 flows out along the outflow channel 6 under the pressure. When the pressure is no longer applied, and the user moves the shaft 7 upward, the pressure in the space below the piston 9 in the pressurizing tube 4 decreases, the pressure in the space above the piston increases, the balloon is no longer expanded, and the part 5 between the main body 1 and the outflow channel 6 is opened. The content 2 enters the outflow channel 6 when the pressure in the air space 3 is increased, and the container is ready to remove the content for the next time.

The part 5 is replaced with a one-way valve whose direction is from the opening to the outflow channel 6. When the content is being removed, the positive pressure is in the outflow channel 6 and the negative pressure is in the main body, so as to close one-way valve tightly. When the user moves the shaft 7 upwards, the negative pressure is generated in the outflow channel 6, while the positive pressure is generated in the main body 1, so that the content can enter the outflow channel 6 more easily, for stacking the effects of the pressures.

Even though the embodiments of the present invention have been described and shown, for a person of ordinary skill in the art, it is understood that various alternations, modifications, substitutions, transformations, and combinations without departing from the spirit of the present invention, can performed on these embodiments. The scope of the invention is only defined by the claims and the equivalents thereof.

What is claimed is:

1. An apparatus for removing a content from a container, including a pressurizing part, a pressure transmitting channel, and an outflow channel, the pressurizing part for applying pressure to an inside of the pressure transmitting channel, through a pressure transmitting medium inside the pressure transmitting channel, to transmit a pressure which is applied by the pressurizing part; and the outflow channel for allowing the content to flow out and preventing the content from flowing back, characterized in that the apparatus also comprises:

a content-removing part located on a bottom of the container between the pressure transmitting channel and the outflow channel, an inside of the content-removing part and/or the pressure transmitting channel is provided with a piston which can move forward or backward along the content-removing part and/or the pressure transmitting channel, the pressure transmitting medium is on a side of the piston, and the content is on the other side thereof, the content-removing part is provided with an opening connected to the content in the container, the moving direction of a mobile device, which can open or close the opening, is vertical with respect to a channel of the opening, when the pressurizing part is applying the pressure, the opening is closed under the pressure, the content in the content-removing part flows out through the outflow channel under the pressure transmitted from the pressure transmitting medium in the pressure transmitting channel, and the pressurizing part, the pressure transmitting channel, or the content-removing part is provided with a reposition device and/or an elastic recovery function so that after the pressure ceases being applied, the pressure transmitting medium flows back to the same position as before the pressure is applied.

2. The apparatus for removing the content from the container as claimed in claim 1, characterized in that the mobile device is a piston disposed in the pressure transmitting channel or the content-removing part, and the piston can slide forward or backward by a positive change or negative change of the pressure at an end of the pressure transmitting channel, so as to open or close the opening.

3. The apparatus for removing the content from the container as claimed in claim 2, characterized in that the piston has a lateral circumferential wall longer than a main body of the piston, and when the pressure is applied, the piston moves to the opening and closes the opening.

4. The apparatus for removing the content from the container as claimed in claim 2, characterized in that a one-way valve which can be opened to the inside of the content-removing part is disposed at the opening, and when the piston moves to the opening, the one-way valve is pressed to close the opening.

5. The apparatus for removing the content from the container as claimed in claim 2, characterized in that the opening is a gap between the content-removing part and the outflow channel, the content-removing part or the pressure transmitting channel has an extendable portion, and when the pressured is applied, the extendable portion is extended to close the gap.

6. The apparatus for removing the content from the container as claimed in claim 2, characterized in that the opening is a gap between the content-removing part and the outflow channel, a sleeve coupled with the piston is disposed in the content-removing part, and the sleeve can close or open the gap through the sliding of the piston.

7. The apparatus for removing the content from the container as claimed in claim 1, characterized in that the apparatus for removing a content from a container further comprises a branch tube, an end of the branch tube is connected to the upstream of the content-removing part, the pressurizing part or the pressure transmitting channel, the opposite end is connected to the mobile device, and the mobile device can open or close the opening with the positive change or the negative change of the pressure in the branch tube.

8. The apparatus for removing the content from the container as claimed in claim 7, characterized in that the mobile device surrounds the opening, and can expand or contract with the positive change or negative change of the pressure in the branch tube.

9. The apparatus for removing the content from the container as claimed in claim 7, characterized in that the mobile device is an elastic balloon located on a side of the plug which closes the opening.

10. The apparatus for removing the content from the container as claimed in claim 7, characterized in that the mobile device is the piston located in the branch tube, and when the pressure is applied, the piston or a slide driven by the piston closes the opening.

11. The apparatus for removing the content from the container as claimed in claim 7, characterized in that the opening is a gap between the content-removing part and the outflow channel, and the mobile device connected to the branch tube is a ring wall of the pressure transmitting channel or the content-removing part, and expands or contracts with the pressure changes, so as to close or open the opening.

12. The apparatus for removing the content from the container as claimed in claim 1, characterized in that the piston is provided with a reposition element, so that the piston can return to a starting position after the pressure is no longer applied.

13. The apparatus for removing the content from the container as claimed in claim 12, characterized in that a blocking element is disposed at a place with a specific distance from a rear section of the content-removing part and/or the pressure transmitting channel for preventing the piston from exceeding the place.

14. The apparatus for removing the content from the container as claimed in claim 1, characterized in that the pressurizing part is a straight tube and applies the pressure through a piston, an outer wall thereof is marked with a scale from a starting position of the piston to the pressure transmitting channel.

15. The apparatus for removing the content from the container as claimed in claim 1, characterized in that the inside of the outflow channel is provided with a one-way valve to prevent the content from flowing back, the one-way valve is disposed on the piston which can slide toward a side the content-removing part within a range along the outflow channel, and an elastic part is disposed to pull the piston to slide toward a side of the content-removing part and then return to a starting position.

16. The apparatus for removing the content from the container as claimed in claim 1, characterized in that a ring wall of the content-removing part or the outflow channel has a function of extending axially toward a side of the pressure transmitting channel within a limited extent and retracting after extending.

17. The apparatus for removing the content from the container as claimed in claim 1, characterized in that the pressure transmitting medium in the pressurizing part and/or the pressure transmitting channel is a liquid, and a wall of the pressurizing part and/or the pressure transmitting channel is marked with a scale for indicating the volume of the liquid flowing out when the pressure is applied.

18. A container having a structure of the apparatus as claimed in claim 1, including a main body of the container, the pressurizing part, the pressure transmitting channel, and the outflow channel, the pressurizing part for applying pressure to the inside of the pressure transmitting channel, through the pressure transmitting medium inside the pressure transmitting channel, to transmit the pressure which is applied by the pressurizing part, and the outflow channel for allowing the content to flow out and preventing the content from flowing back, characterized in that the container further comprises the content-removing part located on the bottom of the container between the pressure transmitting channel and the outflow channel, the inside of the content-removing part and/or the pressure transmitting channel is provided with the piston which can move forward or backward along the content-removing part and/or the pressure transmitting channel, the pressure transmitting medium is on a side of the piston, and the content is on the other side thereof, and the content-removing part is provided with the opening connected to the main body of the container, the removing direction of the mobile device, which can open or close the opening, is vertical with respect to the channel of the opening, when the pressurizing part is applying the pressure, the opening is closed under the pressure, the content in the content-removing part flows out through the outflow channel under the pressure transmitted from the pressure transmitting medium in the pressure transmitting channel, and the pressurizing part, the outflow channel, or the content-removing part is provided with the reposition device and/or the elastic recovery function so that after the pressure is no longer applied, the pressure transmitting medium flows back to the same position as before the pressure is applied.

19. The container as claimed in claim 18, characterized in that the main body of the container is provided with an inlet of outside air, the inlet is an air filtering, purifying, or deoxygenating device, or an inner side of the inlet close to the main body of the container is provided with an inflatable air-collecting device.

20. The container as claimed in claim 18, characterized in that a part of a wall of the main body of the container can be compressed by the atmosphere.

21. The container as claimed in claim 18, characterized in that the pressurizing device is an elastic balloon which has only one opening connected to the pressure transmitting channel.

22. The container as claimed in claim 18, characterized in that an outlet of the outlaw channel is provided with a spraying device or a foam-generating device.

23. The container as claimed in claim 18, characterized in that the main body of the container is provided with a pressurizing device for applying the pressure to the content in the main body of the container.

24. A method in daily use for removing a content from a container, characterized in that the method comprises steps of:

applying pressure to an inside of a pressure transmitting channel by using a pressurizing part for moving a pressure transmitting medium in the pressure transmitting channel, so that an opening of a content-removing part in a main body of the container is closed through a movement of a mobile device whose moving direction is vertical with respect to a channel of the opening, and the content in the content-removing part is moved along an outflow channel through the pressure transmitting medium; and stopping the pressurizing part from applying the pressure, after the removal of the content is complete, so that the content in the content-removing part no longer flows out, the pressurizing part, the pressure transmitting channel, or the content-removing part returns to a starting position and/or elastically recovers, the pressure transmitting medium flows back along the pressure transmitting channel, the opening of the content-removing part in the main body of the container is opened through the movement of the mobile device whose moving direction is vertical to the channel of the opening, and the content in the main body of the container from the opening of the content-removing part in the main body of the container enters the content-removing part, wherein, the mobile device is a piston in the pressure transmitting channel or the content-removing part, or a mobile part connected to a branch tube, and the branch tube is connected to the pressurizing part or the pressure transmitting channel.

25. The method as claimed in claim 24, characterized in the pressure transmitting channel, the content-removing part, or the outflow channel is provided with a device indicating a distance of the content flowing out, for indicating a volume of the content flowing out, and when the volume of the content flowing out is equal to the volume needed, the pressure is no longer applied, and the removal of the content is complete.

* * * * *